US005535990A

United States Patent [19]

Burrage et al.

[11] Patent Number: 5,535,990

[45] **Date of Patent: * Jul. 16, 1996**

[54] APPARATUS FOR ANNEALING/MAGNETIC ANNEALING AMORPHOUS METAL IN A FLUIDIZED BED

[75] Inventors: Lawrence M. Burrage, South Milwaukee; John F. Baranowski, Franklin; Lawrence G. Wilson; Gary L. Goedde, both of Racine; James V. White, Waukesha, all of Wis.

[73] Assignee: Cooper Industries, Inc., Houston, Tex.

[ * ] Notice: The term of this patent shall not extend beyond the expiration date of Pat. No. 5,405,122.

[21] Appl. No.: 372,142

[22] Filed: Jan. 13, 1995

Related U.S. Application Data

[60] Continuation of Ser. No. 17,679, Feb. 12, 1993, Pat. No. 5,405,122, which is a division of Ser. No. 676,316, Mar. 28, 1991, Pat. No. 5,225,005.

[51] Int. Cl.[6] ..... C21D 1/04

[52] U.S. Cl. ..... 266/103; 266/138; 266/252; 266/254; 432/58

[58] Field of Search ..... 266/103, 104, 266/138, 144, 251, 252, 254; 432/58

[56] References Cited

U.S. PATENT DOCUMENTS

| | | | |
|---|---|---|---|
| 2,569,468 | 10/1951 | Gaugler | 148/120 |
| 4,081,298 | 3/1978 | Mendelsohn et al. | 148/121 |
| 4,132,005 | 1/1979 | Coulaloglou | 34/10 |
| 4,249,889 | 2/1981 | Kemp | 266/251 |
| 4,262,233 | 4/1981 | Becker et al. | 148/108 |
| 4,268,325 | 5/1981 | O'Handley et al. | 148/108 |
| 4,368,131 | 1/1983 | Rosenweig | 252/62.55 |
| 4,394,282 | 7/1983 | Seiver | 252/62.55 |
| 4,565,686 | 1/1986 | Kumar | 423/644 |
| 4,649,248 | 3/1987 | Yamaguchi et al. | 148/108 |
| 4,769,091 | 9/1988 | Yoshizawa et al. | 148/108 |
| 4,809,411 | 3/1989 | Lin et al. | 148/108 |
| 4,813,653 | 3/1989 | Piepers | 266/251 |
| 4,877,464 | 10/1989 | Silgailis et al. | 148/108 |
| 4,931,105 | 6/1990 | Woodard | 420/494 |
| 5,181,311 | 1/1993 | Lee | 29/609 |
| 5,252,144 | 10/1993 | Martis | 148/121 |
| 5,291,648 | 3/1994 | Ballard et al. | 29/564.6 |
| 5,310,975 | 5/1994 | Eklund et al. | 219/635 |
| 5,405,122 | 4/1995 | Burrage et al. | 266/252 |

OTHER PUBLICATIONS

ARTICLE: Allied Signal Technical Bulletin, "Magnetic Alloy 2605CA".

ARTICLE: McGraw Edison Bulletin No. 201–10, "Distribution Transformers" (Sep./1982).

ARTICLE: M. Hunt, "Amorphous Metal Alloys" pp. 35–38 (Nov. 1990).

*Primary Examiner*—George Wyszomierski

*Attorney, Agent, or Firm*—Burns, Doane, Swecker & Mathis

[57] ABSTRACT

An apparatus for magnetic annealing of amorphous metal alloy cores. The apparatus includes a fluidized bed for heating the core, a conveyor for transporting the core and immersing the core in the fluidized bed and at least one winding for applying a magnetic field to the core. The apparatus can include a chill bath and/or a second fluidized bed for cooling the core. A chamber can be provided between the two fluidized beds for slow cooling the core by convection and radiation prior to cooling the core at a faster rate in the second fluidized bed.

8 Claims, 2 Drawing Sheets

APPARATUS FOR ANNEALING/MAGNETIC ANNEALING AMORPHOUS METAL IN A FLUIDIZED BED

This application is a continuation of application No. 08/017,679, filed Feb. 12, 1993, now U.S. Pat. No. 5,405,122, which is a divisional of application No. 07/676,316 filed Mar. 28, 1991, now U.S. Pat. No. 5,225,005.

FIELD OF THE INVENTION

The invention relates to a method of annealing and magnetic annealing amorphous metal in a fluidized bed. The method is effective in improving magnetic properties of the amorphous metal and is particularly applicable to transformer cores. The invention also relates to apparatus for magnetic annealing amorphous metal.

BACKGROUND OF THE INVENTION

Heat treatments to improve magnetic properties of ferromagnetic materials are known in the art. For instance, U.S. Pat. No. 2,569,468 ("Gaugler") discloses a treatment wherein ferro-magnetic material is subjected to severe cold reduction sufficient to produce grain-orientation followed by annealing in a magnetic field to produce rectangular hysteresis loops. The materials treated according to the method of Gaugler include 50% Ni-Fe alloys and commercial grades of silicon steel. In one embodiment, a sheet of 50% Ni-Fe alloy is slit into tape which is insulated and wound into spiral cores, the cores are mounted in an annealing pot, the pot is inserted into a furnace at 1000°–1150° C., the cores are heated for two hours and rapidly cooled by withdrawing the pot from the furnace. The cores can be given a second anneal in an atmosphere of pure hydrogen above the magnetic transformation point (Curie temperature, $T_c$) at approximately 500° C. and the cores are cooled slowly in a strong magnetic field of approximately 87 Oersteds. During the second anneal, the cores are suspended or supported in spaced relation within a pot by a suitable medium such as aluminum oxide. Hydrogen is admitted into the pot by way of suitable ports.

It is also known in the art to magnetic anneal amorphous metal alloys to tailor the magnetic properties thereof for specific product applications. A number of magnetic amorphous metal alloys are produced on a commercial scale by Allied Corp., now Allied-Signal, Inc. located in Morristown, N.J. and are marketed under the "METGLAS" trademark. For instance, magnetic annealing treatments for amorphous metal alloys are disclosed in U.S. Pat. No. 4,081,298 ("Mendelsohn"), U.S. Pat. No. 4,262,233 ("Becker"), U.S. Pat. No. 4,268,325 ("O'Handley"), U.S. Pat. No. 4,649,248 ("Yamaguchi"), U.S. Pat. No. 4,668,309 ("Silgailis I"), U.S. Pat. No. 4,769,091 ("Yoshizawa") U.S. Pat. No. 4,809,411 ("Lin"), and U.S. Pat. No. 4,877,464 ("Silgailis II").

Amorphous metal alloys are typically made by rapid quenching from a melt in a continuous casting process. When the cooling rate is high enough (up to millions of degrees per second, depending on the alloy) atomic mobility decreases too rapidly for crystals to form, and no long-range atomic order develops. Amorphous metal alloys containing ferrous or other magnetic metals exhibit increased magnetic permeability because of the absence of long-range order. The amorphous metal alloys typically include metalloid atoms IIIA, IVA, and VA elements such as boron, carbon and phosphorous. The function of the metalloids is to lower the melting point, allowing the alloy to be quenched through its glass transition temperature ($T_g$) rapidly enough to prevent formation of crystals.

The METGLAS alloys include iron-based alloys with additions of boron and silicon such as Alloy Nos. 2605 TCA, 2605 SC, and 2826 MB as well as a cobalt-base alloy (Alloy No. 2714A). The iron-based alloys offer high saturation induction, meaning they can produce very strong magnetic fields. These strong fields are associated with easily-aligned magnetic domains, clusters of like-magnetized atoms.

The major application of iron-based amorphous alloys is for transformer cores, in which they reduce energy lost by the core. Core losses in conventional alloys are associated with Eddy currents, contaminants, and with rotating domains and moving domain walls, which must overcome constraints imposed by the crystalline structure. The lack of this structure and absence of oxide inclusions in amorphous metals reduce these losses. Compared to conventional silicon steel, amorphous alloys used as core material in transformers can reduce wasted energy by as much as 70%.

Amorphous metal alloy ribbons typically have a thickness of only 25 to 40 microns. Accordingly, many layers of material are required to build up a given thickness of winding or lamination.

Of the foregoing U.S. Patents, Mendelsohn discloses that rapid quenching associated with glassy metal processing tends to produce non-uniform stresses in as-quenched filaments of the alloys. Mendelsohn discloses that heat treating tends to relieve these stresses and results in an increase in the maximum permeability. Mendelsohn discloses a heat treatment for glassy magnetic alloys of nominal composition $Fe_{40}Ni_{40}P_{14}B_6$ (all subscripts herein are in atom percent). The heat treatment is performed at a temperature no higher than 350° C. The crystallization temperature ($T_x$) of the alloy is about 375° C. After heating, the alloy is cooled through the Curie temperature $T_c$ (about 247° C.) at a cooling rate no faster than about 30° C./min. The heat treatment can be carried out in the absence of an externally applied magnetic field or by employing a magnetic field of about 1 to 10 Oe during cooling through the Curie temperature. Mendelsohn discloses that the amorphous metal alloy must be substantially glassy, that is, at least about 80% of the alloy as quenched should be glassy. The terms "glassy" and "amorphous" are used interchangeably in the art.

Becker discloses that ferrous amorphous alloys can be processed by magnetic annealing to develop useful AC permeabilities and losses. Becker discloses that ribbons of a ferrous amorphous alloy are heated in a temperature and time cycle which is sufficient to relieve the material of all stresses but which is less than that required to initiate crystallization. For instance, the sample may be either cooled slowly through its Curie temperature $T_c$, or held at a constant temperature below its Curie temperature in the presence of a magnetic field. As an example, Becker discloses that toroidal samples were made by winding approximately 14 turns of MgO-insulated ribbon in a 1.5 centimeter diameter aluminum cup and 50 turns of high temperature insulated wire were wound on the toroid to provide a circumferential field of 4.5 0e for processing. The toroids were sealed in glass tubes under nitrogen and were heat treated for two hours. The alloy had the nominal composition of $Ni_{40}Fe_{40}P_{14}B_6$.

O'Handley discloses annealing of a magnetic glassy metal alloy sheet in a magnetic field. O'Handley discloses that the alloy may include a minor amount of crystalline material but the alloy should be substantially glassy in order to minimize the danger of growth of crystallites at high temperature (above 200° C.), which would lead to a significant loss of soft magnetic properties. O'Handley discloses that alloys such as $Fe_{40}Ni_{40}P_{14}B_6$ and $Fe_{80}B_{20}$ develop exceptionally high permeability as quenched during their processing. The anneal of O'Handley is performed at an elevated temperature below the glass transition temperature $T_g$ and above about 225° C. O'Handley defines the glass transition temperature $T_g$ as the temperature below which the viscosity of the glass exceeds $10^{14}$ poise. The alloy is cooled at a rate of 0.1°–100° C./min. and the annealing is discontinued when the temperature is 100°–250° C., preferably 150°–200° C. O'Handley discloses that the annealing treatment is applicable to wrapped transformer cores comprised of a coiled tape and ring-laminated cores comprised of a stack of circular planar rings. In a specific example, tape-wound toroids of $Fe_{40}Ni_{40}P_{14}B_6$ were annealed at 325° C. for 2 hours and cooled at a rate of 1° C./min. in a 10 Oe circumferential field.

Yamaguchi discloses an annealing furnace for annealing magnetic cores, such as magnetic cores formed of a coiled strip of an amorphous metal alloy having a very thin thickness. Yamaguchi discloses that a conventional method of annealing magnetic cores includes winding a coil around the magnetic core for magnetizing the core, charging the core into an annealing furnace together with the magnetizing coil, evacuating gas in the furnace, introducing inert gas into the furnace and raising the temperature of the furnace to anneal the core in a magnetic field generated by the magnetizing coil. The annealing furnace of Yamaguchi allows the cores to be annealed in a magnetic field in a continuous manner.

Silgailis I and II each disclose a method of magnetic annealing amorphous metal in molten tin. The magnetic annealing is performed by applying a saturation field to the core while it is immersed in a liquid whose temperature is in the range between 0.7–0.8 $T_g$ (the glass transition temperature of the alloy). After annealing, the core is removed and rapidly cooled by immersion in a cooling fluid such as a slurry of acetone/dry ice at minus 78° C. To prevent penetration of molten metal, the core can be coated before immersion in the hot liquid with a material which will eliminate adhesion of the liquid to the core. Alternatively, the core can be wrapped in a protective wrapper such as fiberglass, polyamide film (e.g., "KAPTON" polyamide film), metal foil, etc. In one example, a core wound from amorphous ribbon of $Fe_{78}B_{13}Si_9$ was coated with "NICROBRAZ" dewetting agent and placed into a bath of molten tin-based solder at 400° C., as a saturation magnetic field was applied to the core. When the temperatures of the bath, core skin, and core center were within about ±5% of the soaktemperature, the core was held at that temperature for about 4–8 minutes after which the core was removed from the bath and cooled to room temperature in a slurry of acetone/dry ice at minus 78° C.

Yoshizawa discloses a process of heat treating a magnetic core comprised of an amorphous metal alloy ribbon formed into a toroid. The process includes heating the core to a temperature above the alloy's Curie temperature ($T_c$), slowly cooling the core through the Curie temperature in a DC or AC magnetic field at a rate of 0.1°–50° C./min., heating the core to a temperature between 0.95 $T_c$ and 150° C. for 1–10 hours in a magnetic field and cooling the core to room temperature. The alloy is a Co-based amorphous metal which includes Si and B and other optional additions. The magnetic field is generally coincidental with the direction of the magnetic path of the core.

Lin discloses a method of improving magnetic properties of a wound core fabricated from amorphous strip metal by applying a force in tension to the loop of the innermost lamination. While the tension force is being applied, the loop is annealed and simultaneously subjected to a magnetic field of predetermined strength. The core can be round or it can have a rectangular shape comprised of spaced-apart legs, an upper yoke, and a lower yoke. An associated electrical coil or coils can be assembled about the core by winding the coil or coils about a section of the core in a conventional manner. Alternatively, one of the core yokes or legs may include a joint to provide access into and around the core for positioning an associated electrical coil or coils. The cores can be annealed in a protective atmosphere such as a vacuum, an inert gas such as argon, or a reducing gas such as a mixture of hydrogen and nitrogen. In the case of METGLAS Alloy 2605 SC, the cores are heated from ambient to a temperature of between 340°–370° C. at a heating rate of 10° C./min, held at that temperature for two hours and cooled to ambient at a cooling rate of 10° C./min. METGLAS Alloy 2605 S-2 is heated to a temperature of between 390°–410° C. for the annealing treatment.

Fluidized beds have been used to heat treat metal workpieces. For instance, it is known to continuously heat treat elongated metal work pieces such as ferrous wires by means of a fluidized bed apparatus, as disclosed in U.S. Pat. No. 4,813,653 ("Piepers"). The apparatus of Piepers includes separate fluidized bed modules, each of which comprises a U-shaped vessel containing inert particles to be fluidized by a fluidizing gas.

The existing methods of annealing amorphous metal alloys such as cores typically require long soak times in a conventional oven, with a protective atmosphere such as nitrogen, to obtain uniform heating throughout the metal. Such a heat cycle, combined with a long cooling step, results in a slow, expensive, and inefficient process. In addition, this slow process results in embrittlement of the amorphous metal due to crystal growth and nucleation of crystals during the annealing treatment.

SUMMARY OF THE INVENTION

The invention provides a method of heat treating an amorphous metal alloy, comprising the steps of (1) providing an amorphous metal alloy having an amorphous structure which rapidly recrystallizes when heated to temperatures at least equal to a recrystallization temperature $T_x$, (2) heating the alloy to a temperature below $T_x$, the heating being performed by immersing the alloy in a fluidized bed for a time sufficient to reduce internal stresses in the alloy while minimizing crystal growth and nucleation of crystallites in the alloy, (3) removing the alloy from the fluidized bed and (4) cooling the alloy.

According to one aspect of the invention, the method can be performed on an alloy which exhibits ferromagnetic properties below a Curie temperature $T_c$ of the alloy. In this case, the method further comprises a step of applying a magnetic field to the alloy during and/or after heating the alloy in the fluidized bed. The magnetic field is applied to the alloy for a time sufficient to achieve substantial magnetic domain alignment in the alloy while minimizing crystal growth and nucleation of crystallites in the alloy. The cooling step lowers the temperature of the alloy to no higher than a stabilization temperature $T_s$ to maintain the magnetic domain alignment in the alloy achieved by the magnetic domain alignment step. The magnetic domain alignment step can be performed prior to, during or after the removing step. The removing step is preferably performed when the alloy is heated throughout a cross-section thereof to a critical anneal temperature $T_a$, the critical anneal temperature $T_a$ being within a range of temperatures at which the magnetic domain alignment step is performed. The magnetic field can be applied when the alloy is above or below the Curie temperature but is preferably applied when the alloy is at a temperature no greater than the Curie temperature.

The heating step is preferably performed by maintaining inorganic particles in the fluidized bed in a semi-fluid state by flowing a gas in the fluidized bed. The particles can comprise alumina or silica and the gas can comprise air or preferably nitrogen. However, the gas can comprise an inert gas, a non-oxidizing gas or a reducing gas, or combinations thereof.

The alloy can comprise a core having at least one layer of the amorphous metal alloy. During the heating step, the core is totally immersed in the fluidized bed. The core can include two spaced-apart yokes and two spaced-apart legs forming a continuous magnetic path. The core can include multiple layers of a continuous amorphous metal strip and may or may not include one or more joints for opening the core. For instance, the core can include a plurality of multi-layer packets forming the continuous magnetic path, each of the packets comprising a plurality of foils of the amorphous metal alloy, the core including joint means in one of the yokes or legs, the joint means being formed by butting, gapping or overlapping portions of the packets for opening the core so that the core can be opened up after completion of the magnetic field/heat treatment for placement of one or more pre-formed coil assemblies onto the core leg or legs. In order to generate the magnetic field during the magnetic field/heat treatment, at least one winding can be placed around one of the legs but it is not necessary to open the core for insertion of the winding. The magnetic field preferably aligns the magnetic domains in a direction parallel to the magnetic path. The magnetic field can be applied to the alloy by passing an AC or DC current through a winding having at least one turn extending around a portion of the transformer core. The alloy can consist of an Fe-Si-B eutectic composition. In this case, the Curie temperature of the alloy is above 400° C.

According to one embodiment of the invention, the cooling step comprises immersing the alloy in a chill bath. The chill bath can comprise silicone fluid. The magnetic domain alignment step can be performed immediately upon removal of the alloy from the fluidized bed and while the alloy is immersed in the chill bath. The method can further comprise a step of removing the alloy from the chill bath when the alloy is cooled to a temperature no greater than about 75° C. The chill bath can be circulated through cooling means for cooling the chill bath.

According to a second embodiment of the invention, the fluidized bed comprises a first fluidized bed, the cooling step comprises immersing the alloy in a second fluidized bed after the alloy is removed from the first fluidized bed and the second fluidized bed is maintained at a lower temperature than the first fluidized bed. The alloy can be removed from the first fluidized bed after the alloy is heated uniformly in the first fluidized bed to a temperature no greater than the Curie temperature. The first fluidized bed can be maintained at a temperature of 300° to 400° C. and the second fluidized bed can be maintained at a temperature of 180° to 200° C. The magnetic domain alignment step can be performed while the alloy is in either or both the first and the second fluidized beds. The magnetic domain alignment step can be terminated after the alloy is cooled uniformly to the temperature of the second fluidized bed. The method can further comprise a step of air cooling the alloy after the magnetic domain alignment step is terminated.

According to a third embodiment of the invention, the method includes a step of slow cooling the alloy after the alloy is removed from the fluidized bed, the alloy being slowly cooled by radiation and convection during the slow cooling step. The slow cooling step can be performed by slowly cooling the alloy in a nitrogen gas atmosphere. The fluidized bed can comprise a first fluidized bed, the cooling step can comprise rapid cooling the alloy in a second fluidized bed and the rapid cooling step can be performed after the slow cooling step. The second fluidized bed can be maintained at a temperature of about 20° to 40° C. during the cooling step. The alloy can comprise a core having a pair of spaced-apart legs and a pair of spaced-apart yokes, the legs and yokes forming a continuous magnetic path, the magnetic field being applied by means of two windings, each of the windings including at least one turn surrounding a respective one of the legs and the magnetic domains being aligned in a direction parallel to the magnetic path. The windings can comprise transport means for transporting the core into and out of the fluidized bed during the heating and removing steps.

According to the third embodiment, the alloy can comprise a core and the method can further comprise a step of preheating the core by means of a gaseous medium prior to the heating step. The preheating step can be performed in a first treatment zone of a heating apparatus. The fluidized bed can be located in a second zone of the apparatus. The second zone can be separated from the first zone by door means for allowing the core to pass therethrough and for sealing the first zone from the second zone. The apparatus can include conveyor means for transporting the core from the first zone to the second zone. The heating step can be performed while using the conveyor means to move the core into the second zone and immerse the core in the fluidized bed. The apparatus can include a third zone separated from the second zone by door means for allowing the core to pass therethrough and for sealing the second zone from the third zone. The method can include a step of slow cooling the core in the third zone by means of a gaseous medium, the slow cooling step being performed while using the conveyor means to move the core into the third zone. The apparatus can include a second fluidized bed in a fourth zone of the apparatus. The fourth zone can be separated from the third zone by door means for allowing the core to pass therethrough and for sealing the third zone from the fourth zone. The cooling step can be performed while using the conveyor means to move the core into the fourth zone and by immersing the core in the second fluidized bed. The second fluidized bed can be cooled by circulating a gaseous medium therethrough. The gaseous medium can comprise nitrogen, air, inert gas, oxidizing gas, or reducing gas or combinations thereof. The method can further include a step of withdrawing the gaseous medium heated by heat exchange with the core from at least one of the second, third and fourth zones and supplying the heated gaseous medium to the first zone. The method can also include a step of withdrawing gaseous medium from the first zone, heating the gaseous medium withdrawn from the first zone and circulating the heated gaseous medium in the fluidized bed in the second zone.

The invention also provides an apparatus for magnetic annealing of amorphous metal alloy cores. The apparatus includes a fluidized bed, conveyor means for supporting and transporting an amorphous metal alloy core such that the core can be immersed in the fluidized bed and removed from the fluidized bed, and magnetizing means for applying a magnetic field to the core. The conveyor means can comprise a track and a cradle for supporting the core, the cradle being movable along the track. The magnetizing means can comprise at least one winding means for surrounding a leg or yoke of the core. The apparatus can include a chill bath or second fluidized bed for cooling the core.

The apparatus can include a first zone for preheating the core, the fluidized bed being located in a second zone of the apparatus, the second zone being separated from the first zone by door means for allowing the core to pass therethrough and for sealing the first zone from the second zone, the conveyor means transporting the core from the first zone to the second zone. The apparatus can also include a third zone separated from the second zone by door means for allowing the core to pass therethrough and for sealing the second zone from the third zone, the third zone including means for slow cooling the core with a gaseous medium. The apparatus can include a second fluidized bed in a fourth zone of the apparatus, the fourth zone being separated from the third zone by door means for allowing the core to pass therethrough and for sealing the third zone from the fourth zone, the conveyor means being capable of moving the core into the fourth zone and immersing the core in the second fluidized bed, the second fluidized bed including means for cooling the core by circulating a gaseous medium therethrough.

BRIEF DESCRIPTION OF THE DRAWINGS

The invention will now be described with reference to the accompanying drawings, in which.

DETAILED DESCRIPTION OF THE PREFERRED EMBODIMENTS

Figure 1:
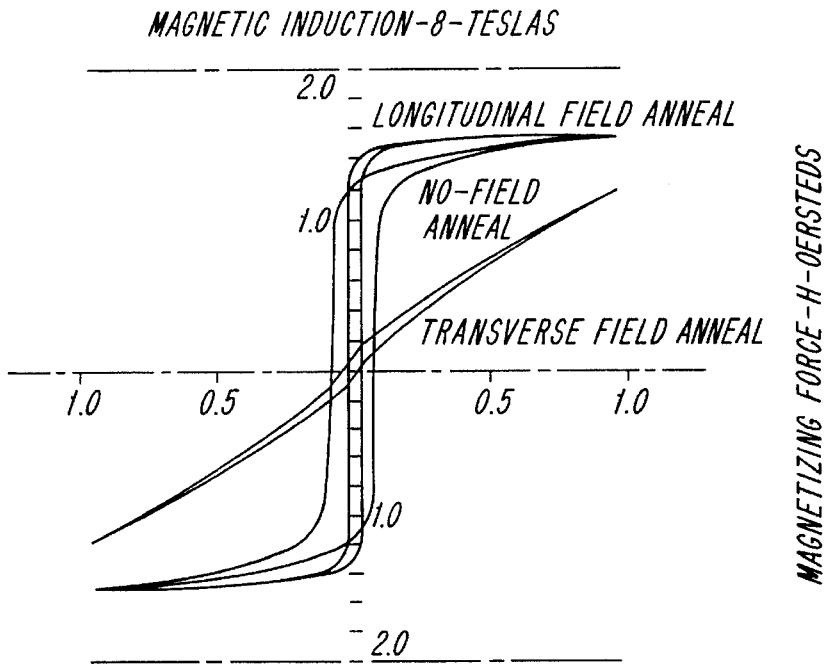
FIG. 1 shows DC hysteresis loops for METGLAS ALLOY 2605 TCA.

The present invention relates to improvements in heat treatment of amorphous metal alloys. More particularly, the invention provides a method of stress-relief annealing amorphous metal alloys. In addition, the invention provides a method of magnetic annealing amorphous alloys exhibiting ferromagnetic properties below the Curie temperature as well as apparatus therefor. According to a preferred embodiment, the invention provides a magnetic annealing treatment for cores, with or without previously formed joints therein.

Any amorphous alloy can be heat treated in accordance with the invention. The magnetic anneal of the invention is applicable to any magnetic amorphous metal alloy.

The amorphous metal alloy treated in accordance with the invention can be provided in various forms. For instance, the alloy can comprise a foil or filament. Alternatively, the alloy can comprise a core of a power transformer, current transformer, potential transformer and reactors/inductors. A typical transformer core of amorphous metal may consist of one, two, three or more loops, depending upon whether the transformer is single phase, three phase, core-form or shell-form in design. The size and weight of the loops depend upon the electrical size of the transformer as well as the design type. The weights of the loops range upward from approximately 110 pounds for a 10 kVA single phase unit. Such a core consists of two legs and two yokes, is generally of rectangular shape (for instance, 9" wide, 12" tall and 6.7" in depth with a core leg thickness of 2.5"). The core can be made up of one or more spirally wound ribbons of amorphous alloy. For instance, the material from which the core is made can be 0.001" thick, 6.7" wide ribbon. The nominal number of ribbons used in such a transformer is 2500.

According to one aspect of the invention, the core can be quadrilateral in cross-section with two opposed yokes and two opposed legs surrounding an opening. The core may or may not include joint means for opening the core. For instance, the core can be formed by a plurality of multi-layer packets forming a continuous magnetic path. Each of the packets includes a plurality of foils of the amorphous metal alloy. The joint means can be provided in one of the yokes or legs (usually in one of the yokes) for opening the core. That is, the joint means allows the core to be opened up after the magnetic field/heat treatment for placement of one or more pre-formed coil assemblies onto the core leg or legs so as to form a transformer. In order to generate the magnetic field during the magnetic field/heat treatment, at least one winding can be placed around at least one of the legs but it is not necessary to open the core for insertion of the winding.

The joint means can be formed by butting, gapping or overlapping portions of the packets. In a gapped joint, a space will be provided between opposed ends of a multi-layer packet. In an overlapped joint, the ends of the multi-layer packet are overlapped by an amount such as about one-fourth inch. In a butt joint, the ends of a multi-layer packet are butted against each other.

The individual joints between opposite ends of each of the multi-layer packets can be arranged in a step-like or echelon pattern. For instance, the individual joints can be offset from each other from left to right so as to form a repeating pattern comprised of a series of parallel, spaced-apart slanted lines connecting the Joints. Alternatively, the Joints can be offset from each other in a chevron pattern which extends repeatedly from left to right and right to left. Accordingly, after the heat treatment in accordance with the invention, the joint can be opened up to permit attachment of one or more pre-formed coil assemblies to the core. The joint is closed after the coil assembly attachment step. The heat treatment of the invention minimizes damage to the foils during the opening and closing of the joint.

Amorphous metal alloys are commercially available in the form of thin ribbons and wires. Such amorphous metal alloys (also called metallic glasses) are characterized by an absence of grain boundaries and an absence of long range atomic order. Methods and compositions useful in the production of such alloys are described in the previously discussed United States patents which are hereby incorporated by reference as background material. Such amorphous alloys may include a minor amount of crystalline material. For purposes of the invention, the amorphous metal alloys should be substantially glassy in order to minimize the danger of growth and nucleation of crystallites at high temperatures (such as above 200° C.), which would lead to a significant loss of soft magnetic properties. For instance, a substantially glassy amorphous metal alloy preferably is at least 80% glassy in the as quenched condition.

Magnetic amorphous metal alloys exhibit a magnetic transformation at the Curie temperature $T_c$. In particular, such alloys exhibit the phenomena of hysteresis and saturation, the permeability of which is dependent on the magnetizing force. Microscopically, elementary magnets are aligned parallel in volumes called "domains". The unmagnetized condition of a ferromagnetic material results from the over-all neutralization of the magnetization of the domains to produce zero external magnetization. A domain is a subsubstructure in a ferromagnetic material within which all the elementary magnets (electron spins or dipoles) are held aligned in one direction by interatomic forces. Magnetic amorphous metal alloys can be heat treated in a magnetic field to provide low hysteresis losses. FIG. 1 shows typical DC hysteresis loops including a longitudinal field anneal, no field aneal and a transverse field anneal for METGLAS Alloy 2605 TCA. Magnetic hysteresis represents the lag of magnetization of a specimen behind any cyclic variation of the applied magnetizing field. METGLAS Alloy 2605 TCA is designed for extremely low core loss in distribution and power transformers and motors. The processed core loss of Alloy 2605 TCA (at 60 Hz, 1.4 Tesla) is about 0.1 watts per pound, or one-fourth the loss of grade M-4 electrical steel. The Curie temperature ($T_c$) of Alloy 2605TCA is 415° C. and the crystallization temperature ($T_x$) of this Alloy is 550° C.

According to one aspect of the invention, a heat treatment is provided for reducing internal stresses while minimizing crystal growth and nucleation of crystallites in amorphous metal alloys. The amorphous metal alloy has an amorphous structure which becomes substantially crystalline at temperatures at least equal to a recrystallization temperature $T_x$. The alloy is heated to a temperature below $T_x$ by immersing the alloy in a fluidized bed for a time sufficient to reduce internal stresses in the alloy while minimizing crystallization by growth and/or nucleation in the alloy. Subsequently, the alloy is removed from the fluidized bed and cooled. The fluidized bed allows uniform heating of the alloy in a rapid, inexpensive and efficient manner. As a result, unwanted crystallization in the alloy can be avoided.

Crystallization in amorphous alloys leads to embrittlement during subsequent handling. For instance, the Silgailis patents referred to above disclose that cores of wound amorphous metal ribbon are subject to breakage when the cores are annealed in molten metal and subsequently unwound from their mandrel and rewound on another mandrel. Such breakage may be due to embrittlement caused by crystallization during the annealing treatment. According to the invention, the amorphous metal alloy can be maintained in the fluidized bed under carefully controlled time and temperature conditions whereby internal stresses can be reduced while minimizing unwanted crystallization. It should be noted, however, that crystallization cannot be totally avoided since grains grow and others are nucleated in amorphous metal alloys at temperatures above absolute zero.

According to a further aspect of the invention, the amorphous metal alloy is a magnetic amorphous alloy which exhibits ferromagnetic properties below the Curie temperature $T_c$ and the method further includes a step of applying a magnetic field to the alloy. The magnetic field is applied at least after heating the alloy in the fluidized bed. For instance, the magnetic field could also be applied before or while the alloy is heated in the fluidized bed. The magnetic field is applied to the alloy for a time sufficient to achieve substantial magnetic domain alignment in the alloy while minimizing crystal growth and crystallization in the alloy. In addition, the cooling step is effective to maintain the magnetic domain alignment achieved by the magnetic domain alignment step.

The magnetic field is preferably a strongly saturating field. The strength of the field can be at least 10 Oersteds. As an example, a 100 ampere current could be used to generate the magnetic field, the current being provided by a motor-generator or alternator or batteries or other power source. In the case of amorphous metal ribbon, the magnetic field is preferably applied such that the magnetic domains are aligned along the longitudinal direction of formation of the ribbon. In the case of a core, the magnetic field is preferably applied such that the magnetic domains are aligned in the direction of the magnetic path through the legs and yokes of the core. Alternatively, the magnetic domains could be aligned in a direction of the width or thickness of the ribbon.

Under ideal conditions, the magnetic field treatment should preferably produce a hysteresis loop with negligible thickness on the induction axis. In this case, the magnetic domain alignment should be close to 100%. Any deviation from such optimum conditions results in less than 100% alignment and thus produces losses. The magnetic field can be an AC or a DC field. The magnetic field can be applied in various ways. For instance, the magnetic field could be applied by providing a plurality of turns of a winding around the alloy. As an example, the winding can include 1 to 6 turns and typically 4 turns.

In order to obtain effective magnetic domain alignment, it is necessary to heat the alloy to a temperature at which there is sufficient atomic mobility to obtain the magnetic domain alignment. However, magnetic domains are not orderable above the Curie temperature and temperatures above the Curie temperature lead to undesired cystallization. According to a preferred embodiment of the invention, the magnetic field is applied only at temperatures below the Curie temperature $T_c$. However, the magnetic field can also be applied above the Curie temperature provided crystal growth and nucleation are minimized. Temperatures at the Curie temperature or just below the Curie temperature are advantageous since nearly 100% magnetic domain alignment can be obtained in a very short time. In order to obtain substantial domain alignment at temperatures below the Curie temperature, longer treatment times of applying the magnetic field are necessary as the temperature decreases. At temperatures too far below the Curie temperature, it is not possible to obtain substantial alignment of the domains even after extremely long periods of time. That is, when the alloy is cooled below a stabilization temperature $T_s$ during the magnetic domain alignment step, the aligned magnetic domains will be maintained at temperatures up to $T_s$.

In the case of Alloy 2605 TCA, it is not possible to obtain effective magnetic domain alignment at temperatures below 180° C. Accordingly, Alloy 2605 TCA is preferably subjected to the magnetic field treatment at a temperature no greater than the Curie temperature and no lower than a $T_s$ of about 180° C. The strength of the magnetic field is preferably far in excess of the normal working range of the ultimate use of the alloy. For instance, if the working level is about 13,500–14,000 Gauss, the magnetic field could be ten times greater.

The alloy is cooled after the annealing or magnetic annealing treatment. In the case where the alloy is in the form of a core, it is desirable to cool the core at a rate which will not cause wrinkling or buckling of inner layers of the core. The cooling rate will depend on the size and mass of the core. For most applications, a cooling rate of 30° C./min or slower is suitable.

The alloy can be removed from the fluidized bed after, before or while the magnetic field is applied to the alloy. According to a preferred embodiment, the magnetic field is not applied to the alloy until after it is removed from the fluidized bed. The alloy is removed from the fluidized bed when the alloy is heated throughout a cross-section thereof to a critical anneal temperature $T_a$. The critical anneal temperature $T_a$ is within a range of temperatures at which the magnetic domain alignment step is performed. The magnetic field is preferably applied to the alloy when the alloy is at a temperature no lower than 25° C. below the Curie temperature. Since the fluidized bed essentially performs an isothermal heat treatment, the temperature of the fluidized bed is preferably close to but below the Curie temperature.

The fluidized bed preferably comprises inorganic particles maintained in a semi-fluid state by a flowing gas. The particles can comprise alumina or silica or other suitable material. The fluidizing gas preferably comprises a non-oxidizing gas such as nitrogen or an inert gas such as argon, xenon or helium. Alternatively, the fluidizing gas can comprise air or a reducing gas such as hydrogen or ammonia.

One advantage of the fluidized bed is that it provides a non-wetting heat transfer medium for heating the amorphous metal alloy. In the case of cores, the size of the particles used in the fluidized bed can be selected to prevent penetration into the core lamination. Also, the degree of fluidization of the particles can be selected to allow the core to be immersed under its own weight.

With the heat treatment of the invention, it is not necessary to wrap the cores in protective material such as fiberglass, polyamide film, metal foil, etc. Also, there is no need to coat the cores treated in accordance with the invention with dewetting material. As such, the heat treatment of the invention offers advantages over the previously discussed Silgailis patents which disclose that dewetting material or a protective wrapper is necessary to prevent molten metal from penetrating the windings of a core heat treated in the molten metal. However, it is within the scope of the invention to provide insulating material on surfaces of the core to minimize thermal gradients during annealing. For instance, in a wound core, the innermost and outermost surfaces can be insulated. Likewise, in a stacked core, the top and bottom flat surfaces can be insulated. In addition, cores treated in accordance with the invention can be covered with dewetting material or a protective wrapper, if desired.

The method according to the invention can be practiced in accordance with the following examples.

EXAMPLE 1

Figure 2:
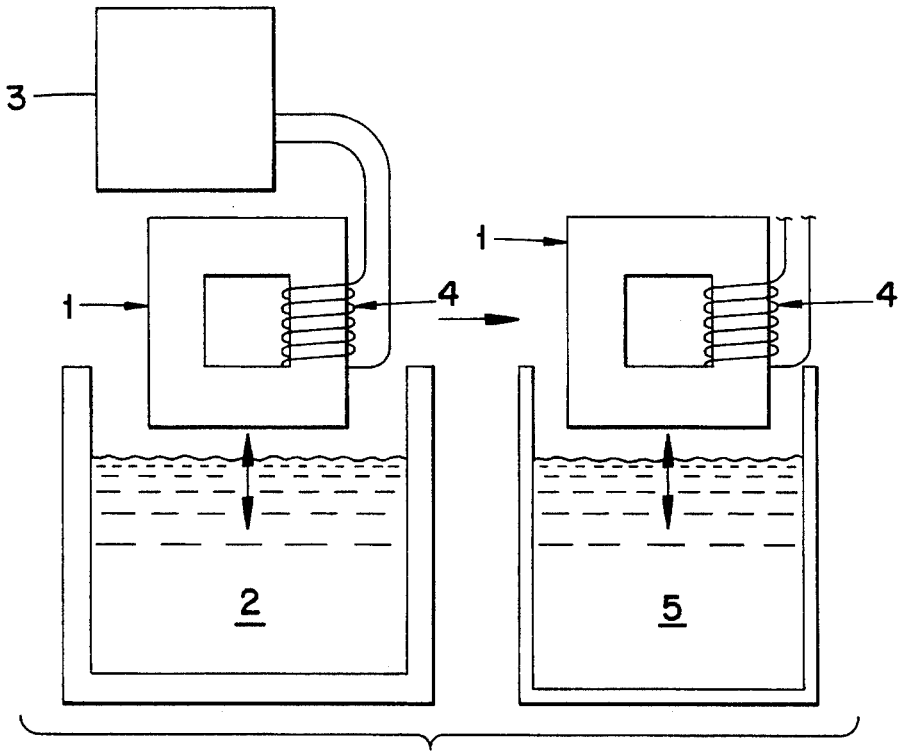
FIG. 2 shows an apparatus according to a first embodiment of the invention.

According to this example of the invention, an amorphous metal transformer core 1 is immersed in a fluidized bed furnace 2 having a temperature in the range of 300°–600° C., as shown in FIG. 2. A nitrogen atmosphere is maintained in the fluidized bed to prevent metal oxidation. Core temperatures are monitored so that as soon as the critical anneal temperature $T_a$ is reached, with proper temperature uniformity throughout the core, the core is removed from the furnace. No soak period is required. Immediately upon removal of the core, a power source 3 provides an intense DC impulse field through a winding 4 to obtain magnetic optimization in the core 1. At the same time, the core is lowered into a chilled bath 5 of silicone fluid. The chill bath provides for a very rapid quench, assuring optimized low loss performance. The chill bath is provided with suitable means to circulate the fluid over the hot core and suitable cooling means to maintain the cold fluid temperature. When the core temperature is below 75° C., the core is removed from the chill bath.

The fluidized bed furnace includes alumina or silica sand as the fluidizing medium. The chill bath utilizes silicone fluid to provide rapid chilling without oxidation of the core. The means for cooling the chill bath can include conventional refrigeration, pumps, or non-oxidizing coolants such as liquid $N_2$, $CO_2$, etc. The transformer cores can be handled by suitable means (not shown) such as a cradle to support the core and one or more cranes attached to the cradle to convey the transformer cores throughout the process.

EXAMPLE 2

Figure 3:
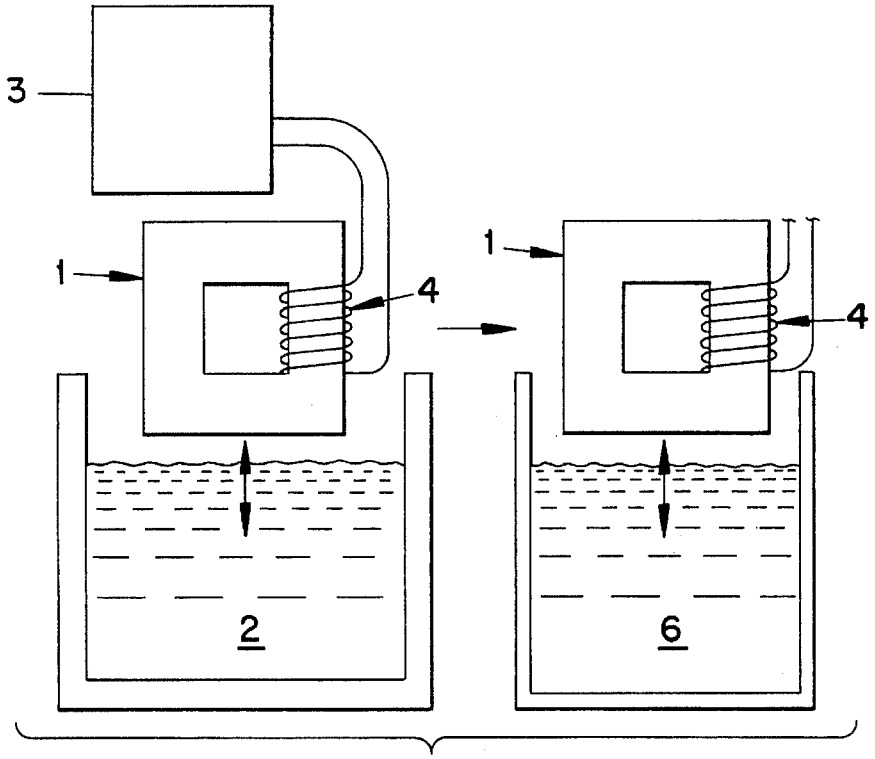
FIG. 3 shows an apparatus in accordance with a second embodiment of the invention.

According to this example, rapid annealing of amorphous cores can be achieved by the use of a two fluidized bed furnace system. The two heated fluidized bed system provides optimum core loss and exciting power performance with one bed temperature set between 300°–400° C. for mechanical stress relief and the second bed set between 180°–200° C. for magnetic domain alignment. In operation, the cores 1 are placed in the first fluidized bed furnace 2 and held until the core's minimum temperature reaches a critical anneal temperature $T_a$ in the 300°–400° C. range, as shown in FIG. 3. The core is then moved to a second fluidized bed 6 that has a temperature between 180°–200° C. After the core's maximum temperature has cooled below 180° C., the AC or DC field is terminated and the core is removed from the furnace. In this example, the magnetic field is applied at all times the core or any part of the core is at 180° C. or above.

For a 4.5 inch amorphous metal core, the total time in the fluidized bed system can be two to three hours which is approximately one-half the time required for a conventional oven anneal. After the core is removed from the lower temperature bed, the core is cooled to ambient temperature.

EXAMPLE 3

According to this example, rapid annealing of amorphous cores can be achieved by the use of a two fluidized bed furnace system. The two heated fluidized bed system provides optimum core loss and exciting power performance with one bed temperature set between 300°–400° C. for mechanical stress relief and the second bed set between 180°–200° C. for magnetic domain alignment. In operation, the cores 1 are placed in the first fluidized bed furnace 2 and held until the core's minimum temperature reaches a critical anneal temperature $T_a$ in the 300°–400° C. range, as shown in FIG. 3. Then, an AC or DC field is applied through the winding 4 and the core is then moved to a second fluidized bed 6 that has a temperature between 180°–200° C. After the core's maximum temperature has cooled to between 180°–200° C., the AC or DC field is terminated and the core is removed from the furnace.

For a 4.5 inch amorphous metal core, the total time in the fluidized bed system can be two to three hours which is approximately one-half the time required for a conventional oven anneal. After the core is removed from the lower temperature bed, the core is cooled to ambient temperature.

EXAMPLE 4

Figure 4:
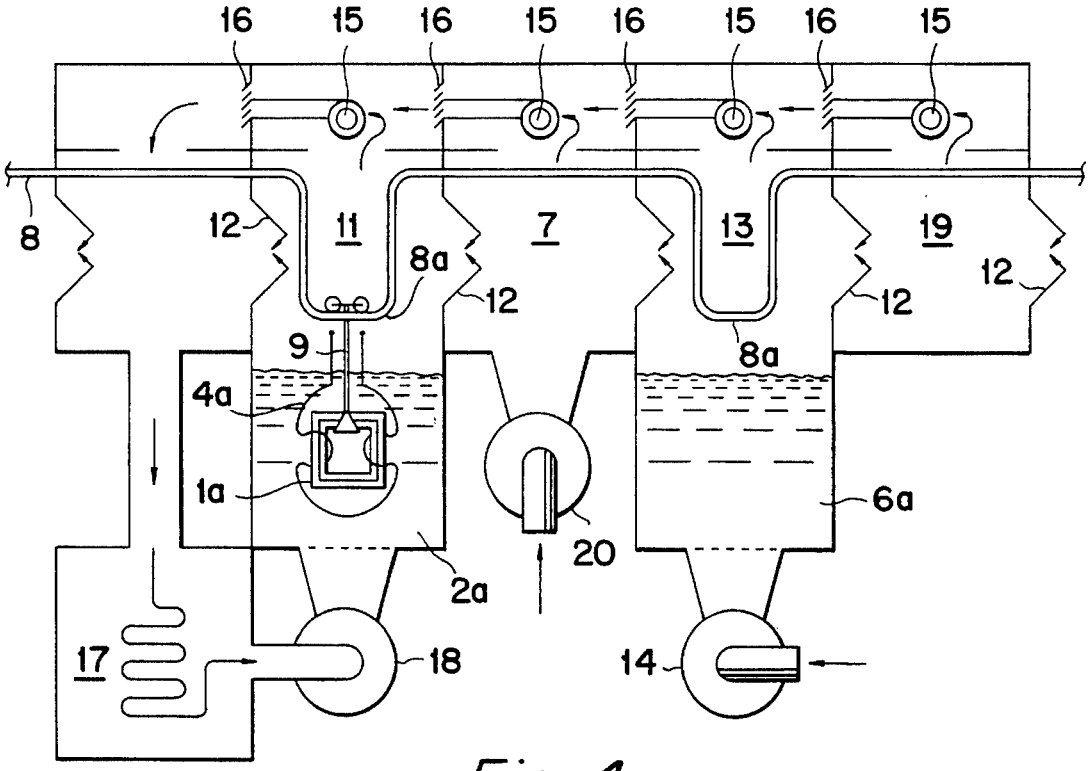
FIG. 4 shows an apparatus in accordance with a third embodiment of the invention.

According to this example, an intermediate chamber is provided between two fluidized beds. In particular, a first heated fluidized bed **2*a* is used to heat a spirally wrapped amorphous core 1*a*, as shown in FIG. 4. The fluidized bed preferably includes a nitrogen gas or air atmosphere. Alternatively, inert gas or reducing gas may be used. The core includes a winding for magnetic domain alignment on each leg and the core is immersed in the fluidized bed la to raise the temperature of the core to a critical anneal temperature $T_a$ of 400° C. in a rapid, uniform and controlled manner. In an intermediate chamber 7, the core is slowly cooled by radiation and convection to a stabilization temperature $T_s$ of 180° C. The intermediate chamber can contain only nitrogen gas. Then, the core is immersed in a second fluidized bed 6***a* which is used as a cooling bed. Either air or preferably nitrogen can be used to achieve rapid cooling of the core to a temperature between 20°–40° C. Then, the magnetic field heat treated core is removed, the field coils are removed and the core is moved to the subsequent core-coil assembly operations.

The magnetic field is preferentially applied continuously during the time the core is at 180° C. or above. The field magnitude is preferably strongly saturating at all temperatures to which the core is subjected during the heat treating process.

The nitrogen gas extracted from the second fluidized bed 6*a* (the cooling bed) and/or from the intermediate chamber 7 can be used as a preheating gas for the first fluidized bed. That is, the core will heat the gaseous medium in the intermediate chamber and the second fluidized bed and this heated gas can be used to reduce the energy requirements for heating the first fluidized bed.

A conventional oven/furnace magnetic field heat treating cycle using circulating gas as the heat exchange medium may require ten's of hours for core sizes in the 25 kVA range. According to the invention, the cycle time for such a core may be reduced to six hours or less.

The field windings can be used as a transport means 8 for transporting the core during the heat treatment in the first fluidized bed, the intermediate chamber and the second fluidized bed. For instance, each of the windings could be encased in a ceramic body provided around a respective one of the legs of the core. Alternatively, the transport means could comprise an overhead track on which a cradle supporting the core travels. The cradle could be extensible to lower the core into the fluidized beds or the track can be configured to include lower sections 8*a* to lower the core into the fluidized beds while the cradle moves along the track.

The core can be preheated by a gaseous medium prior to the heating step. For instance, the preheating step can be performed in a first treatment zone 10 of a heating apparatus wherein the first fluidized bed 2*a* is located in a second zone 11 of the apparatus. The second zone 11 can be separated from the first zone 10 by door means 12 for allowing the core la to pass therethrough and for sealing the first zone 10 from the second zone 11 after the core is moved into the second zone 11. Suitable conveyor means 8 can be provided for transporting the core 1*a* from the first zone 10 to the second zone 11. The heating step can be performed while the conveyor means 8 moves the core into the second zone 11 and immerses the core in the first fluidized bed 1*a*.

The apparatus can also include a third zone or intermediate chamber 7 separated from the second zone 11 by additional door means 12. The method can include a step of slow cooling the core in the third zone 7 by means of a gaseous medium. The slow cooling step can be performed while the conveyor means 8 moves the core la into the third zone 7. The apparatus can also include a fourth zone 13 in which the second fluidized bed 6*a* is located. The fourth zone 13 can be separated from the third zone 7 by another door means 12. The cooling step can be performed while the conveyor means 8 moves the core 1*a* into the fourth zone 13 and immerses the core in the second fluidized bed 6*a*. The second fluidized bed 6a can be cooled by using a blower 14 to circulate a gaseous medium therethrough. The gaseous medium can comprise nitrogen or air and the method can include a step of withdrawing gaseous medium heated by heat exchange with the core from at least one of the second 11, third 7 and fourth 13 zones and supplying the heated gaseous medium to the first zone. The method can also include a step of withdrawing gaseous medium from the first zone 10, heating the gaseous medium by suitable means 17 and circulating the heated gaseous medium by means of a blower 18 in the fluidized bed 2*a* in the second zone 11.

To recirculate heated gaseous medium, the upper portions of zones 11, 7 and 13 can include blowers 15 which circulate the heated gaseous medium through shutters 16 which prevent backflow of the gaseous medium. The directions of flow of the gaseous medium are shown by arrows in FIG. 4. The doors 12 can be arranged such that only one set of doors in each zone can be opened at one time. Also, the apparatus can include an exit air lock 19 and cooling gaseous medium can be supplied to the third zone 7 by means of a blower 20.

While the invention has been described with reference to the foregoing embodiments, various changes and modifications may be made thereto which fall within the scope of the appended claims.

What is claimed is:

1. An apparatus for magnetic annealing of amorphous metal alloy objects, comprising:

at least one fluidized bed;

conveyor means for physically contacting while supporting and transporting an amorphous metal alloy object such that the object can be immersed in the fluidized bed and removed from the fluidized bed; and magnetizing means for applying a magnetic field to the object, the magnetizing means being movably supported on the conveyor means.

2. The apparatus of claim 1, wherein the conveyor means comprises a track and a suspended cradle supporting the object, the cradle being movable along the track.

3. The apparatus of claim 1, wherein the object comprises magnetizable amorphous metal alloy core and the magnetizing means comprises at least one winding means surrounding a leg or yoke of the core.

4. The apparatus of claim 1, wherein the fluidized bed includes means for heating the object and the apparatus further includes a chill bath including means for cooling the object.

5. The apparatus of claim 1, wherein the fluidized bed includes heated particles and gas circulating means for heating the particles and the apparatus further includes a first zone for preheating the object, the fluidized bed being located in a second zone of the apparatus, the second zone being separated from the first zone by door means for allowing the object to pass therethrough and for sealing the first zone from the second zone, the conveyor means transporting the object from the first zone to the second zone.

6. The apparatus of claim 5, further comprising means for withdrawing gaseous medium from the first zone, heating the gaseous medium withdrawn from the first zone and circulating the heated gaseous medium in the fluidized bed in the second zone.

7. The apparatus of claim 1, wherein the magnetizing means includes means for continuously generating a magnetic field.

8. The apparatus of claim 1, wherein the magnetizing means comprises part of the conveyor means.

* * * * *